US010988364B2

(12) United States Patent
Bamford

(10) Patent No.: US 10,988,364 B2
(45) Date of Patent: Apr. 27, 2021

(54) CARBONATION TANK ASSEMBLY

(71) Applicant: Leonard FountainSpecialties, Inc., Detroit, MI (US)

(72) Inventor: John J. Bamford, New Baltimore, MI (US)

(73) Assignee: Leonard Fountain Specialties, Inc., Detroit, MI (US)

( * ) Notice: Subject to any disclaimer, the term of this patent is extended or adjusted under 35 U.S.C. 154(b) by 265 days.

(21) Appl. No.: 15/975,201

(22) Filed: May 9, 2018

(65) Prior Publication Data

US 2018/0327246 A1 Nov. 15, 2018

Related U.S. Application Data

(60) Provisional application No. 62/503,653, filed on May 9, 2017.

(51) Int. Cl.

| | |
|---|---|
| ***B67D 1/00*** | (2006.01) |
| ***B01F 3/04*** | (2006.01) |
| ***B01F 15/00*** | (2006.01) |
| ***B01F 15/02*** | (2006.01) |

(Continued)

(52) U.S. Cl.

CPC ..... *B67D 1/0057* (2013.01); *B01F 3/04808* (2013.01); *B01F 3/2014* (2013.01); *B01F 15/00357* (2013.01); *B01F 15/026* (2013.01); *B01F 15/0238* (2013.01); *B01F 15/0292* (2013.01); *B01F 15/0416* (2013.01); *B67D 1/006* (2013.01); *B67D 1/0071* (2013.01); *B01F 2003/049* (2013.01); *B01F 2215/0022* (2013.01)

(58) Field of Classification Search

CPC .... B67D 1/0057; B67D 1/006; B67D 1/0071; B01F 15/0238; B01F 15/0416; B01F 3/2014; B01F 3/04808; B01F 15/00357; B01F 15/0292; B01F 15/026; B01F 2215/0022; B01F 2003/049

See application file for complete search history.

(56) References Cited

U.S. PATENT DOCUMENTS

| | | | | |
|---|---|---|---|---|
| 5,792,391 A * | 8/1998 | Vogel | B67D 1/0057 | 261/121.1 |
| 8,808,775 B2 * | 8/2014 | Novak | B65D 85/8043 | 426/394 |
| 9,861,942 B1 * | 1/2018 | Paul | B01F 13/0062 | |

(Continued)

OTHER PUBLICATIONS

"Elastomer" Wikipedia published Jan. 25, 2015 accessed at <https://en.wikipedia.org/w/index.php?title=Elastomer&oldid=644093260> (Year: 2015).*

(Continued)

*Primary Examiner* — Stephen Hobson

(74) *Attorney, Agent, or Firm* — The Weintraub Group, P.L.C.

(57) ABSTRACT

The invention provides a carbonation tank assembly for admixing a gas and a potable liquid used in preparation of drinks. The assembly includes a tank body with an interior that can be easily accessed for cleaning and repair purposes by removing upper and lower end plates securely and sealing fitted by gaskets to the upper and lower ends of the tank. The interior is connected to a liquid source for supplying liquid, a gas source for carbonating the liquid, and drawing means for dispensing carbonated liquid from the interior of the tank.

18 Claims, 1 Drawing Sheet

(51) Int. Cl.
*B01F 15/04* (2006.01)
*B01F 3/20* (2006.01)

(56) References Cited

U.S. PATENT DOCUMENTS

| | | | | |
|---|---|---|---|---|
| 10,017,372 | B2 * | 7/2018 | Bethuy | B67D 1/0041 |
| 10,688,450 | B2 * | 6/2020 | Rueter | B01F 3/04787 |
| 10,688,451 | B1 * | 6/2020 | Santoiemmo | B01F 3/04787 |
| 10,744,468 | B2 * | 8/2020 | Cheng | B01F 5/0476 |
| 2011/0042834 | A1 * | 2/2011 | Pensa | B01F 3/04808 261/50.3 |
| 2014/0030383 | A1 * | 1/2014 | Marchetti | B67D 1/0004 426/67 |
| 2014/0331868 | A1 * | 11/2014 | Novak | B01F 3/04248 99/323.2 |
| 2015/0313401 | A1 * | 11/2015 | Chichilnisky | A23L 2/54 261/129 |
| 2015/0328599 | A1 * | 11/2015 | Schroeder | B67D 1/0057 261/27 |
| 2015/0329341 | A1 * | 11/2015 | Wilder | F17C 1/00 206/0.6 |
| 2016/0015074 | A1 * | 1/2016 | Njaastad | B01F 3/04106 426/477 |
| 2016/0255991 | A1 * | 9/2016 | Givens, Jr. | B01F 3/04808 |
| 2016/0325243 | A1 * | 11/2016 | McDonald | B67D 1/1275 |
| 2016/0332123 | A1 * | 11/2016 | Trulaske | A47G 19/2233 |
| 2017/0120204 | A1 * | 5/2017 | Tipton | B01F 15/00175 |
| 2017/0266630 | A1 * | 9/2017 | McDonald | B01F 11/0241 |
| 2017/0362071 | A1 * | 12/2017 | Showalter | B01F 15/00837 |
| 2017/0369298 | A1 * | 12/2017 | Walton | B67D 1/0858 |
| 2018/0080952 | A1 * | 3/2018 | Lehtonen | B01F 15/00175 |
| 2018/0327246 | A1 * | 11/2018 | Bamford | B01F 15/00357 |
| 2019/0015797 | A1 * | 1/2019 | Asis | B01F 3/04794 |
| 2019/0160438 | A1 * | 5/2019 | Knoll | B67D 1/0057 |
| 2019/0217256 | A1 * | 7/2019 | Fantappie | B01F 13/0006 |
| 2019/0270630 | A1 * | 9/2019 | Dahan | E03C 1/0404 |
| 2019/0328170 | A1 * | 10/2019 | Cai | A47J 31/521 |
| 2020/0255604 | A1 * | 8/2020 | Sakamoto | B01F 7/0025 |
| 2020/0261864 | A1 * | 8/2020 | Blackburn | B01F 3/1221 |

OTHER PUBLICATIONS

"O-ring" Wikipedia published Sep. 21, 2015 accessed at <https://en.wikipedia.org/w/index.php?title=O-ring&oldid=682085393> (Year : 2015).*

* cited by examiner

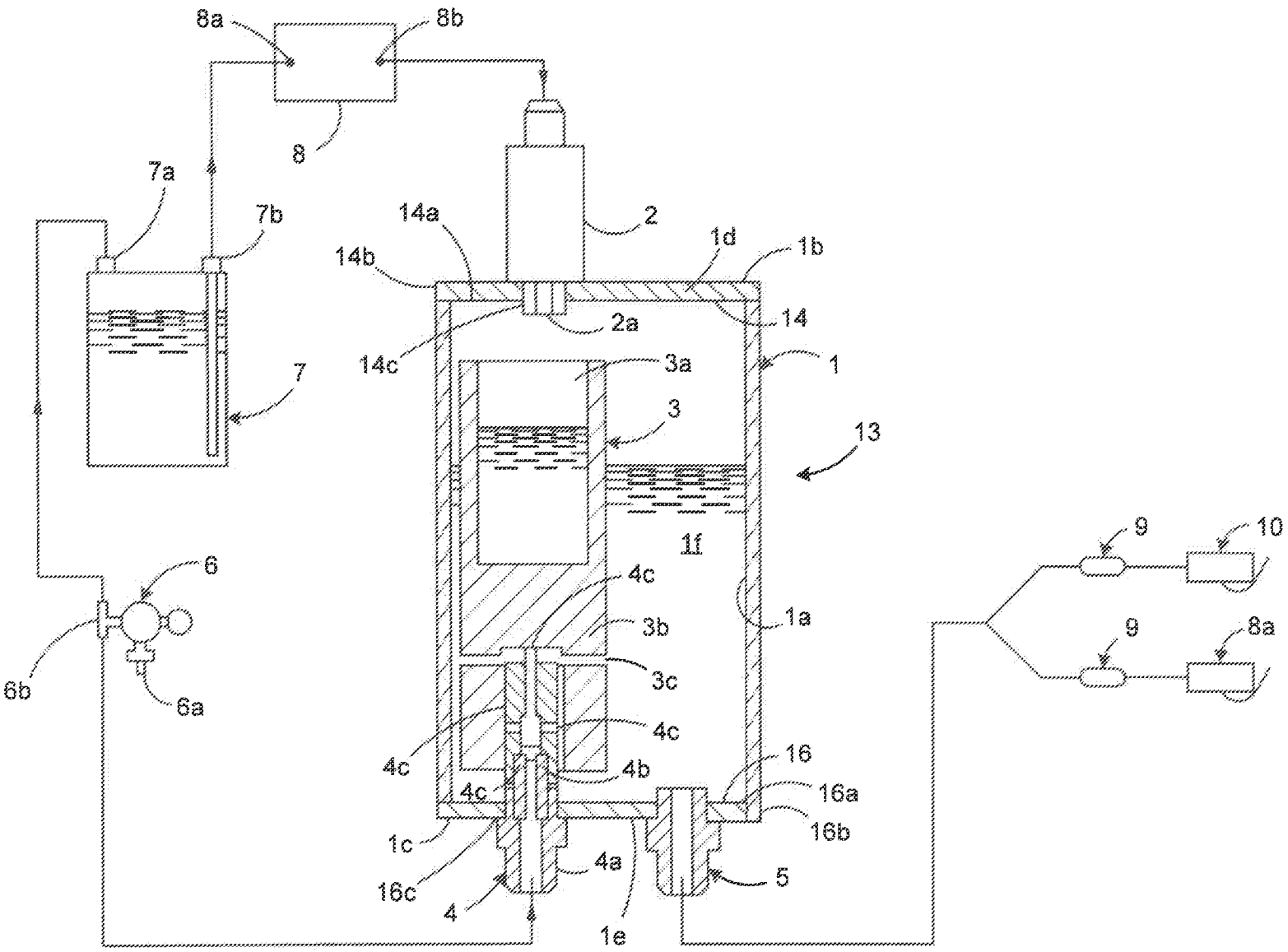
10
8a
9
9
13
1
1b
14
1d
1a
16
16a
16b
5
1f
2
2a
3a
3
4c
3b
3c
4c
4b
1e
4a
4
4c
4c
1c
16c
14a
14b
14c
8b
8
8a
7b
7
7a
6
6a
6b

CARBONATION TANK ASSEMBLY

CROSS-REFERENCE TO RELATED APPLICATIONS

This Application is a completion application of co-pending U.S. Provisional Application Ser. No. 62/503,653 filed May 9, 2017 for "Carbonation Tank Assembly", the entire disclosure of which is hereby incorporated by reference in its entirety including the drawing.

BACKGROUND OF THE INVENTION

1. Field of the Invention

The present invention pertains to tanks for admixing a gas and a liquid. More particularly, the present invention concerns carbonation tank assemblies. Even more particularly, the present invention pertains to carbonation tank assemblies including a tank with an interior that can be easily accessed for cleaning and repair purposes.

2. Description of Related Art

Carbonation systems, which admix a gas and a liquid in order to carbonate the liquid, are well known in the art. Carbonation systems that are characterized by small or medium capacity are particularly adapted for limited commercial use or home use as they do not require a motor and associated pump assembly. These motorless systems rely on the utilization of a pressurized gas tank, such as a carbon dioxide tank, in order to supply the tank with sufficient pressure to facilitate the admixing of the gas with a liquid in the tank and dispense the resulting carbonated liquid therefrom. In doing so, the static pressure in the tank must be less than the pressure in a liquid source such that liquid from the liquid source is drawn into the tank.

The prior art accomplishes this by using various flow rate control means. For example, U.S. Pat. No. 2,809,597 to Fowler, U.S. Pat. No. 4,093,681 to Castillo et al., U.S. Pat. No. 4,225,537 to Martonffy, U.S. Pat. No. 4,889,662 to Smith, U.S. Pat. No. 4,940,164 to Hancock et al., U.S. Pat. No. 4,950,431 to Rudick et al., and U.S. Pat. No. 5,152,935 to Robertson, which are hereby incorporated by reference in their entirety, teach motorless carbonation systems including a tank for admixing a carbonating gas with a liquid. Carbon dioxide is introduced into the tank in order to carbonate the liquid therein. Thereafter, the carbonating liquid may be dispensed through an outlet. These devices further teach the incorporation of cooling means, such as a cold plate or a cooling liquid circulating within the tank.

Additionally, U.S. Pat. Nos. 3,394,847, 4,271,097, and 4,313,897 to Gerrard, which are hereby incorporated by reference in their entirety, teach carbonation systems for equalizing pressure within a carbonation tank. The Gerrard patents teach a specific float element being disposed within the tank to control the amount of gas entering the tank. Based on the pressure within the tank, which is altered by resulting carbonated liquid being dispensed therefrom or too much carbon dioxide entering the tank, the float element raises or lowers accordingly. As the float element raises or lowers, the rate at which carbon dioxide and liquid enter the tank is adjusted in order to equalize the pressure within the tank.

However, in each of the prior art references, the tanks thereof are sealed enclosures. The only components that are taught as being removable are the inlets and outlets thereof to facilitate transportation of the system. Thus, the prior art fails to teach accessing the interior of the tanks of the systems for cleaning or repair.

It is to this to which the present invention is directed.

SUMMARY OF THE INVENTION

The present invention provides a carbonation tank assembly having an interior that can be accessed for cleaning and repair when necessary. The assembly comprises: (a) a carbonation tank including an open-ended tank body having an upper end and a lower end, a top wall removably secured to the upper end of the tank body, and a bottom wall disposed opposite the top wall and abutting against the lower end of the tank body, the tank body, the top wall, and the bottom wall cooperating to define an open interior within the tank; (b) a top sealing gasket for removably securing the top wall to the tank body; (c) a bottom sealing gasket for removably securing the bottom wall to the tank body; (d) a liquid inlet valve removably mounted to the tank and connectable to a liquid source; (e) a gas inlet valve removably mounted to the tank and connectable to a gas source; and (f) a carbonated liquid outlet valve removably mounted to the tank and connectable to drawing means.

The top and bottom sealing gaskets are preferably formed from rubber or any other suitable, deformable material in order to at least partially envelop the top and bottom walls, respectively. The gaskets also envelop a portion of the tank body in order to secure the top and bottom walls thereto. To enable the liquid inlet valve, the gas inlet valve, and the carbonated liquid outlet valve to connect to the tank, a least one opening is formed in each of the gaskets so as to not obstruct these connections.

Preferably, in order to normalize the amount of gas and liquid entering the tank, the tank includes a float member disposed within the tank and responsive to the level of a liquid therein.

Accordingly, the present invention maintains a constant amount of liquid and gas in the tank by adjusting the flow rates of liquid and gas entering the tank based on the rate of carbonating liquid being dispensed therefrom.

For a better understanding of the present invention, reference is made to the accompanying drawing and detailed description. In the drawing, like reference numerals refer to like parts through the several views, in which:

BRIEF DESCRIPTION OF THE DRAWING

FIG. 1 is a cross-sectional front view of a representative carbonation tank assembly in accordance with the present invention, the carbonation tank assembly being shown in a schematic view in use with a preferred carbonation system.

DETAILED DESCRIPTION OF THE INVENTION

It is to be understood that the carbonation tank assembly discussed hereinbelow may be used in combination with a motor and a pump to facilitate the supply of fluid and gas into a tank. Alternatively, the assembly may be used in combination with a motorless carbonation system which relies on pressure from a gas source to establish sufficient pressure within the tank.

It is to be noted that the present invention hereof has particular utility with the gas and liquid admixing systems taught in U.S. Pat. Nos. 3,394,847, 4,271,097, and 4,313,897 to Garrard, the disclosures of which are hereby incorporated by reference in their entirety.

Now, in accordance with the present invention and with reference to FIG. 1 of the drawing, there is provided a carbonation tank assembly 13 having an interior that can be easily accessed for cleaning and repair purposes. The assembly 13 hereof is a standalone device which may be used as a retrofit in combination with a variety of carbonation systems without being limited to any one system or environment.

As shown in the drawing, the carbonation tank assembly 13 is illustrated in a schematic representation as being used in combination with a preferred motorless carbonation system 12 without limiting the scope of the present invention.

With more particularity, the assembly 13 comprises: (a) a carbonation tank 1 including a tank body 1*a* having an upper end 1*b* and a lower end 1*c*, a lid or cover or top wall 1*d* removably secured on the upper end 1*b* of the tank body 1*a*, and a bottom wall 1*e* disposed opposite the top wall 1*d* and abutting against the lower end 1*c* of the tank body 1*a*, the tank body 1*a*, the top wall 1*d*, and the bottom wall 1*e* cooperating to define an enclosed interior 1*f* within the tank 1; (b) a top sealing gasket 14 for removably securing the top wall 1*d* to the tank body 1*a*; (c) a bottom sealing gasket 16 for removably securing the bottom wall 1*e* to the tank body 1*a*; (d) a liquid inlet valve 2 removably mounted to the tank 1 and connectable to a liquid source; (e) a gas inlet valve 4 removably mounted to the tank 1 and connectable to a gas source; and (f) a carbonated liquid outlet valve 5 removably mounted to the tank 1 and connectable to drawing means.

It is to be understood that the critical aspect of the present invention is the top wall 1*d* and the bottom wall 1*e* of the tank 1 being removably attachable to the tank body 1*a*. As a result, the top wall 1*d* and the bottom wall 1*e* may be removed from the tank body 1*a* in order to facilitate cleaning and repairing when necessary of the interior 1*f* of the tank 1 when necessary.

The tank body 1*a* includes an upper end 1*b* and a lower end 1*c*. The tank body 1*a* may comprise any geometric shape, such as an open-ended cylinder having a single sidewall. Alternatively, the tank body 1*a* may comprise a plurality of sidewalls to provide a tank 1 having any suitable polygonal geometry.

The tank body 1*a* may be formed from any suitable material for purposes of carbonating a liquid therein such as aluminum, steel, or the like.

To fully enclose the interior if of the tank 1, the top wall 1*d* is positioned over the upper end 1*b* of the tank body 1*a* and the bottom wall 1*e* is positioned below and abutted against the lower end 1*c* of the tank body 1*a*.

As discussed in detail below, a top sealing gasket 14 and a bottom sealing gasket 16 are used to removably secure the top wall 1*d* and the bottom wall 1*e*, respectively, to the tank body 1*a*.

The top sealing gasket 14 includes a base 14*a* and a sidewall 14*b* extending substantially normal to the base 14*a* from an outer edge thereof. Preferably, the top sealing gasket 14 further includes at least one opening 14*c* formed in the base 14*a* thereof to accommodate the connection between the liquid inlet valve 2 and the tank 1. Therefore, the opening 14*c* must have a diameter at least as large as the diameter of the liquid inlet valve 2 at its point of engagement with the tank 1. Alternatively, the base 14*a* may include an opening 14*c* having a diameter substantially larger than the liquid inlet valve 2. At the very least, the base 14*a* and the sidewall 14*b* must be sufficiently wide enough to wrap around and secure the top wall 1*d* of the tank to the tank body 1*a* thereof.

It is to be understood that the top sealing gasket 14 may comprise any number of sidewalls extending from the base 14*a* and of any geometry in order to sufficiently mate with the top wall 1*d* of the tank 1 and the tank body 1*a*.

Similar to the top sealing gasket 14, the bottom sealing gasket 16 comprises a base 16*a* and a sidewall 16*b* extending substantially normal from an outer edge of the base 16*a*. The bottom sealing gasket 14 is positionable over the bottom wall 1*e* of the tank 1 to removably secure the bottom wall 1*e* to the tank body 1*a*.

Preferably, at least one opening 16*c* is formed in the base 16*a* in order to accommodate the gas inlet valve 4 and the carbonated liquid outlet valve 5 connecting to the tank 1. Moreover, a pair of openings 16*c* may be formed in the base 16*a*, each having a diameter at least as large as the valve extending therethrough. However, a single opening having a diameter large enough to allow for both the gas inlet valve 4 and the carbonated liquid outlet valve 5 to extend through would suffice.

Preferably, the top and bottom sealing gaskets 14, 16 are formed from an elastomeric material such as a natural rubber, a synthetic rubber, or any other suitable, deformable material in order to at least partially envelop the top and bottom walls 1*d*, 1*e*, respectively. Forming the sealing gaskets 14, 16 from an elastomer provides sufficient flexibility to stretch the sealing gaskets 14, 16 around the top and bottom walls 1*d*, 1*e*, respectively, and the tank body 1*a*. As a result, the sealing gaskets 14, 16 may engage the top and bottom walls 1*d*, 1*e* and seal them to the tank body 1*a* in a sealing manner.

As the tank 1 fills with liquid, a substantial amount of downward force is applied to the bottom wall 1*e*. Similarly, as gas is supplied to the tank 1, the interior if becomes highly pressurized which applies upward force to the top wall 1*d*. If the sealing gaskets 14, 16 begins to shift out of position or slide from the tank body 1*a*, there is great risk of leakage from the tank 1. Therefore, the material in which the sealing gaskets 14, 16 are manufactured from must be able to maintain their positions on the tank body 1*a* despite the weight of the liquid and the buildup of gas within the tank 1.

The liquid inlet valve 2 may be removably mounted in either the top wall 1*d* of the tank 1 or the tank body 1*a* to direct liquid from a liquid source into the tank 1. The liquid inlet valve 2 includes an orifice 2*a* from which liquid is dispensed. Preferably, the liquid inlet valve 2 is a check valve for controlling the flow rate of liquid being dispensed. The liquid inlet valve 2 may be removed from the tank 1 by any suitable means such as screwing or the like.

The gas inlet valve 4 is a check valve, removably mounted within either the top wall 1*d* of the tank 1 or the tank body 1*a*, which directs the flow of a carbonating gas from a gas source into the tank 1. The gas inlet valve 4 may be removed from the tank 1 by any suitable means such as screwing or the like.

The carbonated liquid outlet valve 5 may be removably mounted in either the tank body 1*a* or the bottom wall 1*e* of the tank 1. The carbonated liquid outlet valve 5 is a check valve ensuring that carbonated liquid only flows in one direction out of the tank 1. Additionally, the carbonated liquid outlet valve 5 may be removed from the tank 1 for cleaning or repair purposes when necessary, similar to the liquid inlet valve 2 and the gas inlet valve 3.

As noted above, once the sealing gaskets 14, 16 are removed in order to release the top and bottom walls 1*d*, 1*e* from the tank body 1*a*, the interior if thereof may be accessed for cleaning or repair. Cleaning the interior if of the tank body 1*a* is performed in any suitable manner known to one of ordinary skill in the art. This may include sanitizing the inner surface of the tank body 1*a* using a non-toxic disinfectant.

When the present invention disclosed hereinabove is employed in a motorless carbonation system, the assembly 13 further comprises means for equalizing the pressure in the tank 1. Preferably, the means for equalizing includes a float member 3 disposed within the tank 1 which is responsive to the level of a liquid therein.

The float member 3 is disposed within the interior if of the tank 1 and positioned directly below the liquid inlet valve 2. The float member 3 includes a mixing well 3*a* formed in the top thereof which receives liquid from the liquid inlet valve 2. The liquid within the mixing well 3*a* is then mixed with gas supplied to the tank 1. Once the liquid is carbonated, the carbonated liquid overflows into the tank 1.

The float member 3 includes a recess 3*b* formed in the bottom thereof to accommodate the gas inlet valve 4. The float member 3 further includes a drilled passageway 3*c* formed in a sidewall thereof in order to place the recess 3*b* in fluid communication with the interior if of the tank 1.

Preferably, the float member 3 is made of polyethylene, polypropylene, or a similar material that is impervious to carbonated liquid. Additionally, the material chosen to form the float member 3 must have a specific gravity less than that of the liquid in the tank 1 in order to allow the float member 3 to be responsive to changes in the liquid level in the tank 1.

When the float member 3 is employed, the gas inlet valve 4 works in combination with the float member 3 to control the amount of gas being supplied to the interior if of the tank 1. Therefore, the gas inlet valve 4 further comprises a gas inlet fitting 4*a*, a plastic sleeve 4*c*, an orifice member 4*b*, and a needle 4*e*. Preferably, the plastic sleeve 4*c* is Teflon, the orifice member 4*b* is Nylon, and the needle 4*e* is stainless steel.

Here, the gas inlet fitting 4*a* includes a vertical bore formed in the upper end thereof in which the orifice member 4*b* is pressed into. A portion of the orifice member 4*b* extends above the gas inlet fitting 4*a* allowing for the sleeve 4*c* to be frictionally secured therearound.

The sleeve 4*c* also includes a vertical bore formed therein, which provides a channel for the needle 4*e* to freely move within. Moreover, the sleeve 4*c* provides a drilled passageway 4*d* which directs the flow of inlet gas towards the recess 3*b* and into the interior if of the tank 1 through the passageway 3*c*. Directing the gas in this manner prevents the gas from being immediately drawn out of the tank 1 through the carbonated liquid outlet valve 5.

The needle 4*e* includes a bottom, tapered end that is positionable within the orifice member 4*b* and an upper end that is in contact with the recess 3*b* of the float member 3. As described below, the needle 4*e* restricts the flow of gas flowing out therefrom as the needle 4*e* translates vertically in and out of the orifice member 4*b*.

It is to be understood that the gas inlet valve 4, including the fitting 4*a*, the orifice member 4*b*, the sleeve 4*c*, and the needle 4*e*, may be unscrewed from the tank 1 and removed as a complete unit. Thus, the entire gas inlet valve 4 may be easily inspected and repaired when necessary.

As noted above, the carbonation tank assembly 12 is shown in use with a preferred motorless carbonation system 12.

Here, the tank 1 is connected to a liquid source 7, a gas source 6*b*, and drawing means for dispensing carbonated liquid, the drawing means comprising at least one flow regulator 9 and an associated dispensing valve 10.

The liquid source 7, which contains a supply of liquid to be carbonated such as water or juice, includes a gas inlet fitting 7*a* and a liquid outlet fitting 7*b*. The gas inlet fitting 7*a* receives gas from the gas source 6*b* to pressurize the liquid source 7. Due to a pressure differential between the liquid source 7 and the tank 1, the liquid outlet fitting 7*b* then draws liquid out of the liquid source 7 and into the tank 1.

Additionally, a cold plate 8 having an inlet fitting 8*a* and an outlet fitting 8*b* may be disposed intermediate the liquid source 7 and the tank 1 to cool the liquid as it passes therethrough. The cold plate 8 may comprise any suitable, commercially available cooling device which allows for a liquid to flow through. When the cold plate 8 is utilized, the liquid outlet fitting 7*b* in the fluid source 7 is connected to the inlet fitting 8*a* of the cold plate 8 and the outlet fitting 8*b* of the cold plate 8 is connected to the liquid inlet valve 2.

A pressure regulator 6 is connected to the gas source 6*b*, such as a carbon dioxide tank, at a port 6*a*. Thus, the gas source 6*b* supplies gas at about 90 psi to about 100 psi to both the liquid source 7 and the tank 1 via the gas inlet fitting 7*a* and the gas inlet valve 4, respectively.

Once the liquid in the tank 1 has been sufficiently carbonated, as discussed below, the carbonated liquid outlet valve 5 directs the carbonated liquid out of the tank 1 and to the flow regulator 9 and the dispensing valve 10. In some cases, the flow regulator 9 may be an integral part of the dispensing valve 10. The flow regulator 9 maintains a constant flow rate to the dispensing valve 10 regardless of some variation of pressure in the tank 1. This is especially desired when the carbonation system 12 includes a pair of dispensing valves 10, as shown, and are used simultaneously.

In use, the carbonation system 12 hereof operates to maintain a stable pressure within the tank 1 by controlling the rate at which gas and fluid is supplied thereto. As shown, the liquid level in the tank 1 is illustrated as it would exist with none of the dispensing valves 10 open. The liquid level is the mixing well 3*a* is the residue from the carbonated liquid from a previous draw cycle, which filled the mixing well 3*a* to overflow.

Here, the float member 3 exerts almost no downward force onto the needle 4*e* in order to ensure the gas inlet valve 4 remains open. With no restriction on the gas inlet valve 4, the pressure in the tank 1 and the liquid source 7 remain equal. As a result, no gas or liquid is supplied to the tank 1.

Once one of the dispensing valves 10 are opened, the resulting carbonated liquid flows out of the tank 1 through the carbonated liquid outlet valve 5. Preferably, the flow regulator 9 maintains a constant flow of ¼ ounces per second, which is typical in the industry. Dispensing carbonated liquid from the tank 1 causes the pressure in the tank 1 to drop below the level in the gas source 6*b* and the liquid source 7. This pressure differential induces the flow of gas and liquid into the tank 1 through the gas inlet valve 4 and the liquid inlet valve 2, respectively, in order to normalize the pressures.

The rate at which gas and liquid flow into the tank 1 is directly proportional to the positioning of the needle 4*e* within the orifice member 4*b* of the gas inlet valve 4. As the liquid level in the tank 1 drops, more gravitational force is applied to the float member 3, which applies an increasing amount of downward force onto the needle 4*e* causing a gas restriction. The gas restriction during the draw of carbonated liquid will encourage more liquid to be supplied into the tank 1. Additional downward force is also applied to the needle 4*e* as liquid entering the tank 1 fills the mixing well 3*a*. However, the liquid level only falls to a point at which the gas restriction is sufficient to cause the rate of liquid entering the tank 1 to equal the rate of liquid being dispensed therefrom. When these two rates equal one another, the liquid level in the tank 1 stabilizes at a point on the float member 3.

If liquid enters the tank 1 too fast, the liquid level will rise, reducing the gas restriction and allowing more gas to enter. As a result, the rate of liquid entering the tank 1 is reduced to match the rate of the carbonated liquid leaving the tank 1. Consequently, the gas inlet valve 4 operates in combination with the float member 3 and the liquid inlet valve 2 to control the gas flow rate directly and liquid flow rate indirectly in exact proportions to one another. This maintains a constant flow of the carbonated liquid to the dispensing valves 10 and provides a steady liquid level at an intermediate point on the float member 3.

It is to be understood that incoming gas from the gas inlet valve 4 does not deliver a significant upward force on the needle 4*e* which would cause it to inadvertently move upward. Any significant upward velocity of entering gas leaving the orifice member 4*b* is absorbed by the bore in the sleeve 4*c* connecting with the passageway 4*d*.

Once the dispensing valves 10 are closed, the pressure in the tank 1 quickly equalizes with regards to the pressure in the gas source 6*b* and the liquid source 7, thereby stopping the flow of liquid and gas into the tank 1 almost instantly.

Additionally, the size of the orifices of both the liquid inlet valve 2 and the gas inlet valve 4 play a critical role in normalizing the rate of gas and liquid being supplied to the tank 1. Preferably, the liquid orifice 2*a* to gas orifice 4*b* ratio is about 2:1 in orifice area or about 7:1 in orifice diameter. For example, a liquid orifice 2*a* diameter of about 7/63 and a gas orifice 4*a* diameter of about 5/64 is found to provide optimal flow rates.

From the above, it is to be appreciated that defined herein is a new and unique carbonation tank assembly including a tank that can be opened from opposing ends in order to access the interior thereof for cleaning and repair purposes.

What is claimed is:

1. A carbonation tank assembly having an interior that can be accessed for cleaning and repair, the assembly comprising:

(a) a carbonation tank including an open-ended tank body having an upper end and a lower end, a top wall removably secured to the upper end of the tank body, and a bottom wall disposed opposite the top wall and abutting against the lower end of the tank body, the tank body, the top wall, and the bottom wall cooperating to define an open accessible interior within the tank;

(b) a top sealing gasket for removably securing the top wall to the tank body;

(c) a bottom sealing gasket for removably securing the bottom wall to the tank body;

(d) a liquid inlet valve removably mounted to the tank and connectable to a liquid source;

(e) a gas inlet valve removably mounted to the tank and connectable to a gas source; and (f) a carbonated liquid outlet valve removably mounted to the tank and connectable to drawing means, the drawing means for dispensing carbonated liquid; and (g) a float member disposed in the tank having an upwardly open mixing well formed in the top thereof which receives liquid from the liquid inlet well, the float member equalizing pressure in the tank.

2. The carbonation tank assembly of claim 1, wherein the top and bottom sealing gaskets are formed from a deformable material in order to at least partially envelop the top and bottom walls, respectively.

3. The carbonation tank assembly of claim 2 wherein the gaskets envelop a portion of the tank body in order to secure the top and bottom walls to a portion of the tank body in order to secure the top and bottom walls thereto.

4. The carbonation tank assembly of claim 2 wherein to enable the liquid inlet valve, the gas inlet valve, and the carbonated liquid outlet valve to connect to the tank, at least one opening is formed in each of the gaskets so as to not obstruct these connections.

5. The carbonation tank assembly of claim 2 wherein to normalize the amount of gas and liquid entering the tank, the tank includes a float member disposed within the tank and responsive to the level of a liquid therein.

6. The carbonation tank assembly of claim 1 wherein a constant amount of liquid and gas is maintained in the tank by adjusting the flow rates of liquid and gas entering the tank based on the rate of carbonating liquid being dispensed therefrom.

7. The carbonation tank assembly of claim 1 wherein the drawing means comprises at least one flow regulator and an associated dispensing valve.

8. A carbonation tank assembly having an interior that can be accessed for cleaning and repair, the assembly comprising:

(a) a tank body having top and bottom ends adjacent respective upper and lower walls, cooperating to define the accessible interior the interior being connected to a liquid source for supplying liquid thereinto and a gas source for carbonating the liquid, (b) upper and lower plates that are removably connected, respectively, to the top and bottom ends of the tank, (c) upper and lower sealing gaskets, each said gasket attached to a respective of said upper and lower plates, each gasket including a base and a sidewall extending substantially normal to the base from an outer edge thereof, the base being abuttable against respective of the plates and respective end of the tank and the sidewall being sufficiently wide enough to wrap around and secure a respective plate to a respective end of the tank body thereof to allow access to the interior, (d) drawing means for dispensing carbonated liquid from the interior of the tank, and (e) a float member disposed in the tank having an upwardly open mixing well formed in the top thereof which receives liquid from the liquid inlet well, the float member equalizing pressure in the tank.

9. The carbonation tank assembly of claim 8, wherein the drawing means comprises at least one flow regulator and an associated dispensing valve.

10. The carbonation tank assembly of claim 8, further comprising the upper and lower sealing gaskets formed from an elastomeric material of sufficient flexibility to stretch the sealing gaskets around the outer periphery of a respective of the upper and lower plates and around the outer surface of a respective upper and lower wall of the tank body proximate the respective top and bottom ends.

11. The carbonation tank assembly of claim 10, wherein the elastomeric material of the gaskets is a deformable material in order to at least partially envelop the top and bottom ends, respectively, of the tank body.

12. The carbonation tank assembly of claim 11, wherein the bottom sealing gasket comprises a base and a sidewall extending substantially normal from an outer edge of the base thereof, the bottom sealing gasket being positionable over the lower plate with the base thereof sandwiched between the lower plate and the bottom end of the tank in order for the sidewalls thereof to sufficiently sealingly engage and removably secure the lower plate to the outer surface of the lower end of the tank body.

13. The carbonation tank assembly of claim 10, wherein said upper sealing gasket comprises a base and a number of sidewalls extending substantially normal from an outer edge of the base thereof, the base of the upper sealing gasket bring positionable under the upper plate and sandwiched between the upper plate and the top end of the tank in order for the sidewalls thereof to sufficiently sealingly engage and removably secure the upper plate to the outer surface of the upper wall of the tank body.

14. The carbonation tank assembly of claim 10, wherein said upper sealing gasket is sufficiently wide enough to wrap around and secure the upper plate to the upper end of the tank body.

15. The carbonation tank assembly of claim 8, further comprising a liquid inlet valve removably mounted to the tank and connectable to said liquid source; a gas inlet valve removably mounted to the tank and connectable to said gas source; and a carbonated liquid outlet valve removably mounted to the tank and connectable to said drawing means drawing means for dispensing carbonated liquid.

16. The carbonation tank assembly of claim 15, wherein the liquid within the mixing well mixes with gas supplied to the tank, the liquid is carbonated, and the carbonated liquid overflows the mixing well and flows into the tank.

17. The carbonation tank assembly of claim 16, wherein the float member is comprised of a material having a specific gravity less than that of the liquid in the tank in order to allow the float member to be responsive to changes in the liquid level in the tank.

18. The carbonation tank assembly of claim 8, wherein a constant amount of liquid and gas is maintained in the tank by adjusting the flow rates of liquid and gas entering the tank based on the rate of carbonating liquid being dispensed therefrom.

* * * * *